US010517782B2

(12) United States Patent
Haynes

(10) Patent No.: US 10,517,782 B2
(45) Date of Patent: Dec. 31, 2019

(54) SHOPPING BASKET ASSEMBLY

(71) Applicant: Delores Haynes, Coconut Creek, FL (US)

(72) Inventor: Delores Haynes, Coconut Creek, FL (US)

( * ) Notice: Subject to any disclaimer, the term of this patent is extended or adjusted under 35 U.S.C. 154(b) by 0 days.

(21) Appl. No.: 15/954,701

(22) Filed: Apr. 17, 2018

(65) Prior Publication Data

US 2019/0314230 A1 Oct. 17, 2019

(51) Int. Cl.
*A61G 5/10* (2006.01)

(52) U.S. Cl.
CPC ..... *A61G 5/1094* (2016.11)

(58) Field of Classification Search
CPC ..... A61G 5/10; A61G 5/1094
USPC ..... 224/407, 684; 280/304.1; D12/133
See application file for complete search history.

(56) References Cited

U.S. PATENT DOCUMENTS 4,257,545 A 3/1981 Rhyan
4,305,601 A 12/1981 Berge
4,526,419 A 7/1985 Bowman et al.
4,577,903 A * 3/1986 Wells ..... A61G 5/10 224/407
4,580,803 A 4/1986 Davis
4,795,182 A 1/1989 Dyess et al.
5,301,975 A * 4/1994 Rivera ..... A61G 5/10 135/88.01
5,356,059 A 10/1994 Yanez et al.
5,667,236 A * 9/1997 Murphy ..... A61G 5/1018 188/2 F
5,794,957 A * 8/1998 Mendon ..... A61G 5/10 280/204
5,813,582 A 9/1998 Wright
D451,054 S 11/2001 Thom et al.
D488,659 S * 4/2004 Post ..... D6/566
8,794,655 B1 8/2014 Gipson
9,452,098 B1 * 9/2016 Howard ..... A61G 5/1094
D810,632 S * 2/2018 Smith ..... D12/133
2008/0156838 A1 7/2008 Johnson

* cited by examiner

*Primary Examiner* — Scott T McNurlen

(57) ABSTRACT

A shopping basket assembly for carrying shopping items on a wheelchair includes a wheelchair that has a pair of handles for gripping to roll the wheelchair. A pair of sleeves is provided and each of the sleeves is slidably positioned on a respective one of the handles on the wheelchair. A panel is provided and each of the sleeves is coupled to the panel. Thus, the panel extends downwardly from the handles when the sleeves are positioned on the handles. A pair of baskets is each coupled to the panel to support shopping items positioned in the baskets.

4 Claims, 5 Drawing Sheets

SHOPPING BASKET ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to basket devices and more particularly pertains to a new basket device for carrying shopping items on a wheelchair.

BRIEF SUMMARY OF THE INVENTION

An embodiment of the disclosure meets the needs presented above by generally comprising a wheelchair that has a pair of handles for gripping to roll the wheelchair. A pair of sleeves is provided and each of the sleeves is slidably positioned on a respective one of the handles on the wheelchair. A panel is provided and each of the sleeves is coupled to the panel. Thus, the panel extends downwardly from the handles when the sleeves are positioned on the handles. A pair of baskets is each coupled to the panel to support shopping items positioned in the baskets.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
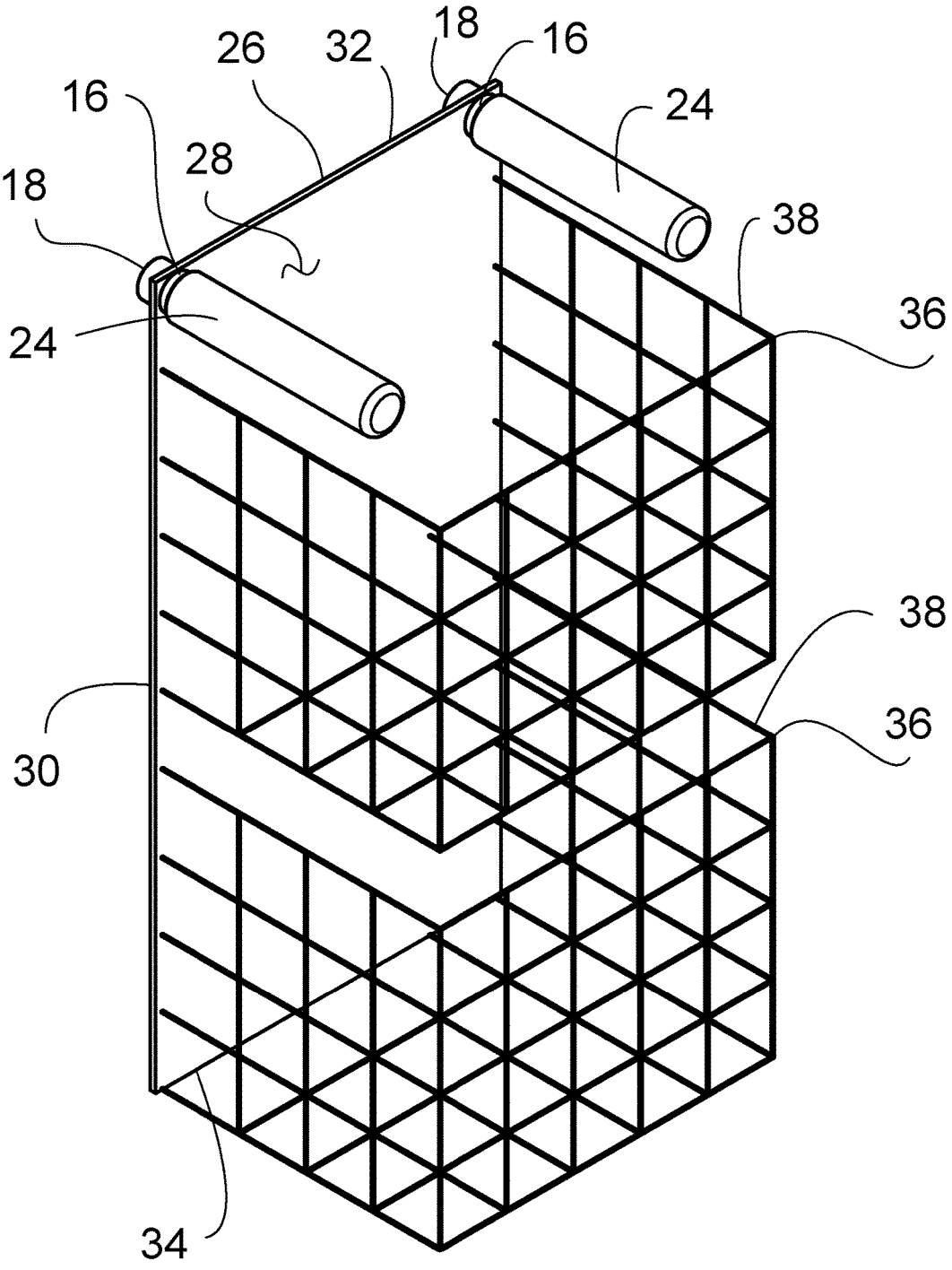
FIG. 1 is a perspective view of a shopping basket assembly according to an embodiment of the disclosure.
Figure 2:
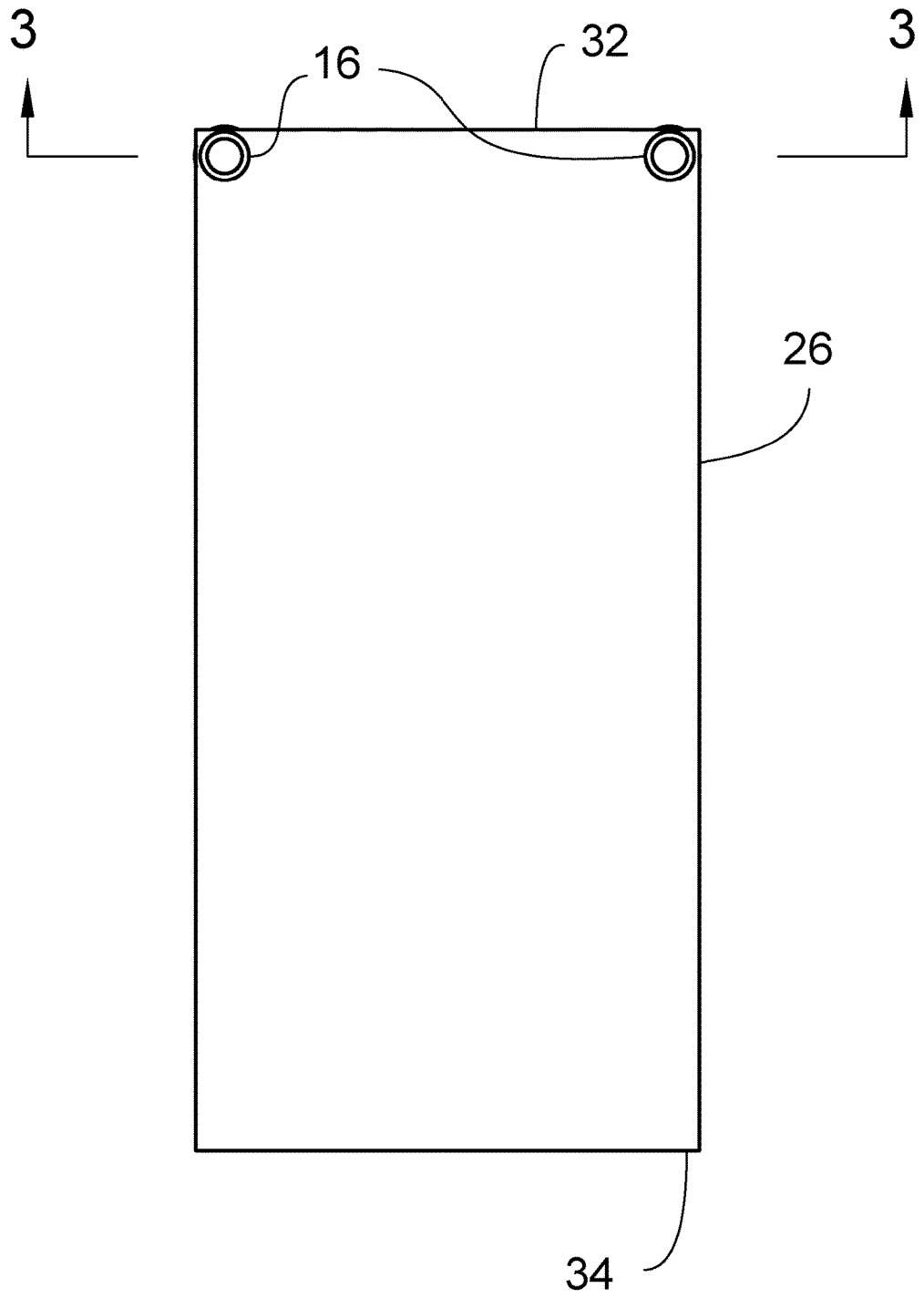
FIG. 2 is a front view of an embodiment of the disclosure.
Figure 3:
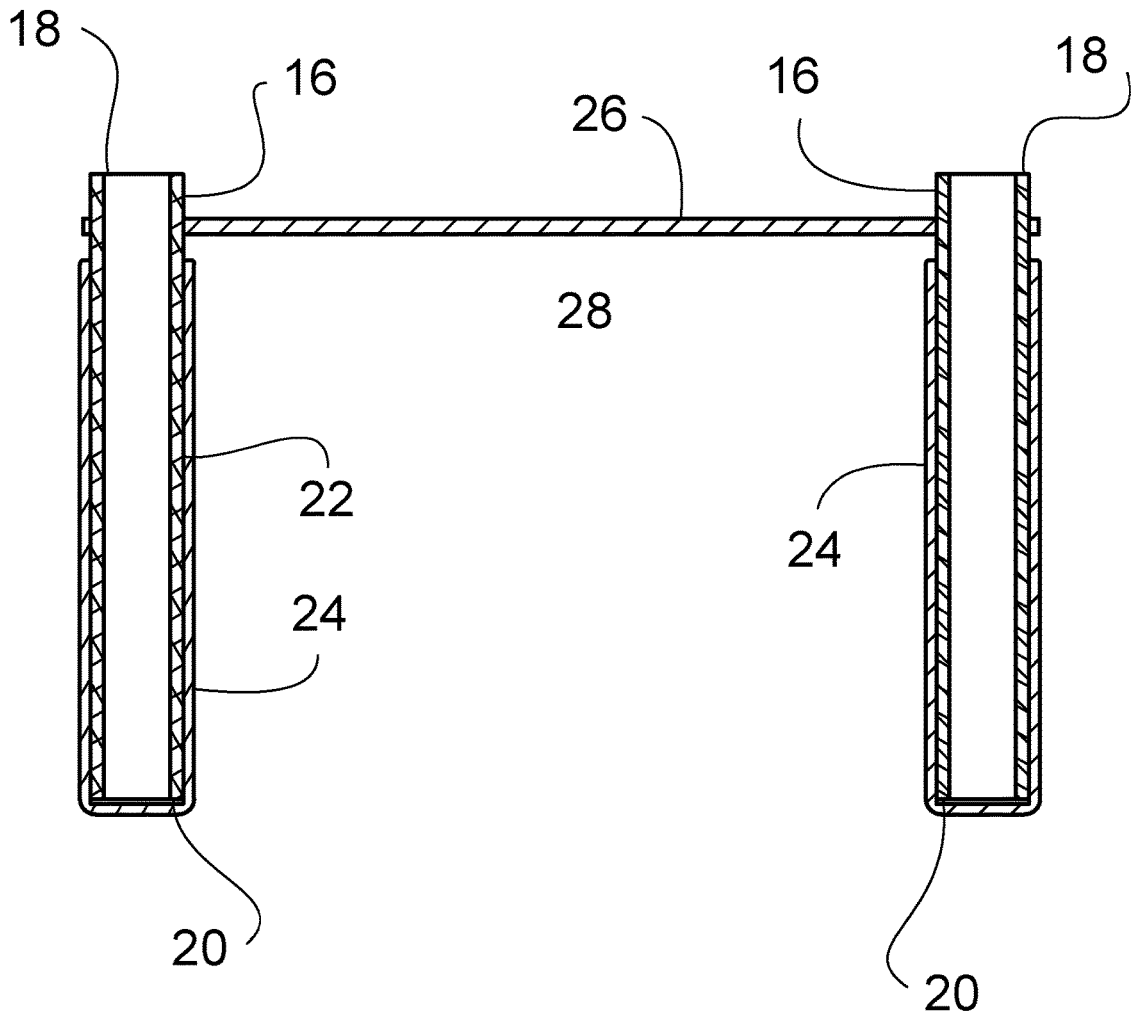
FIG. 3 is a cross sectional view taken along line 3-3 of FIG. 2 of an embodiment of the disclosure.
Figure 4:
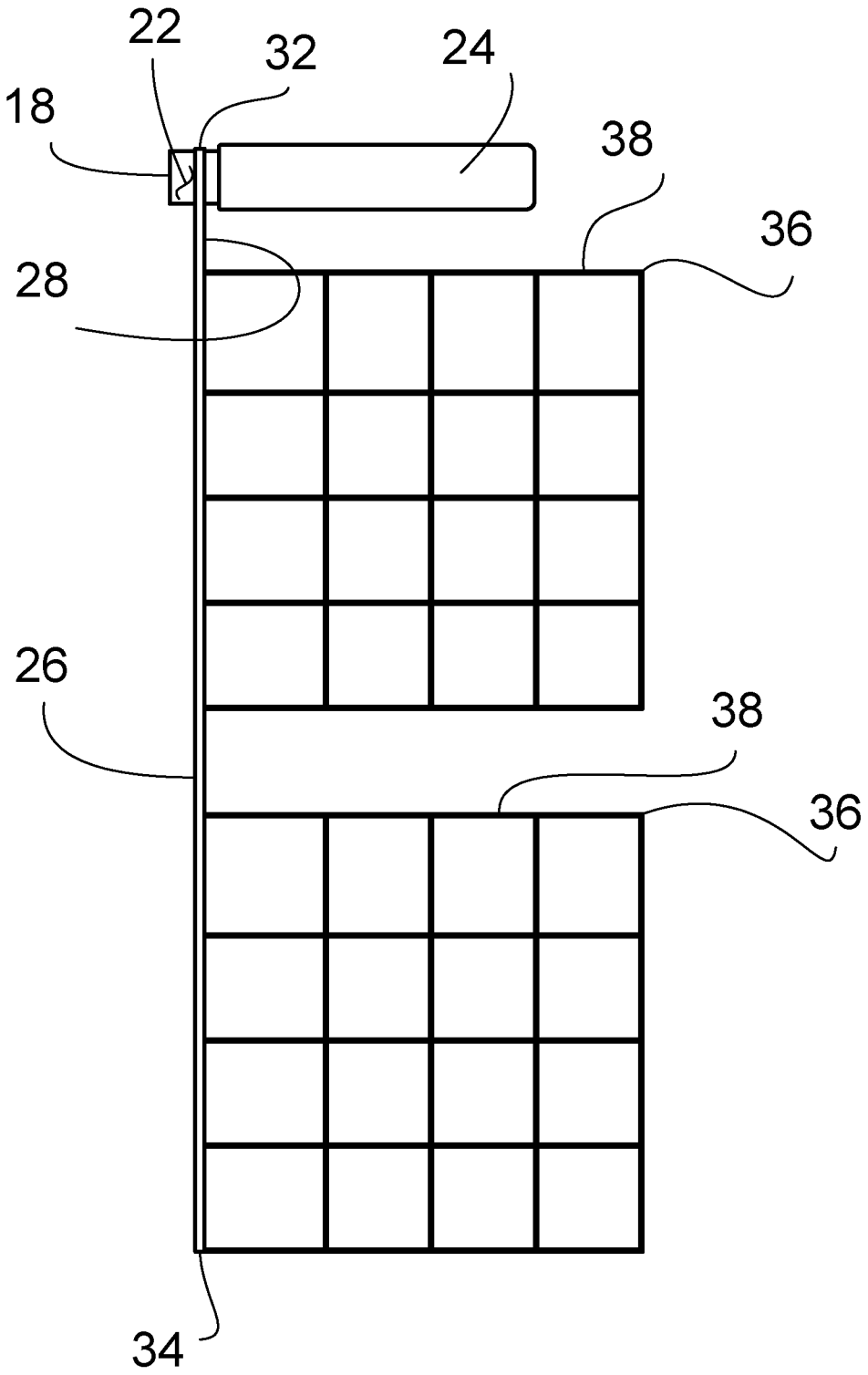
FIG. 4 is a left side view of an embodiment of the disclosure.
Figure 5:
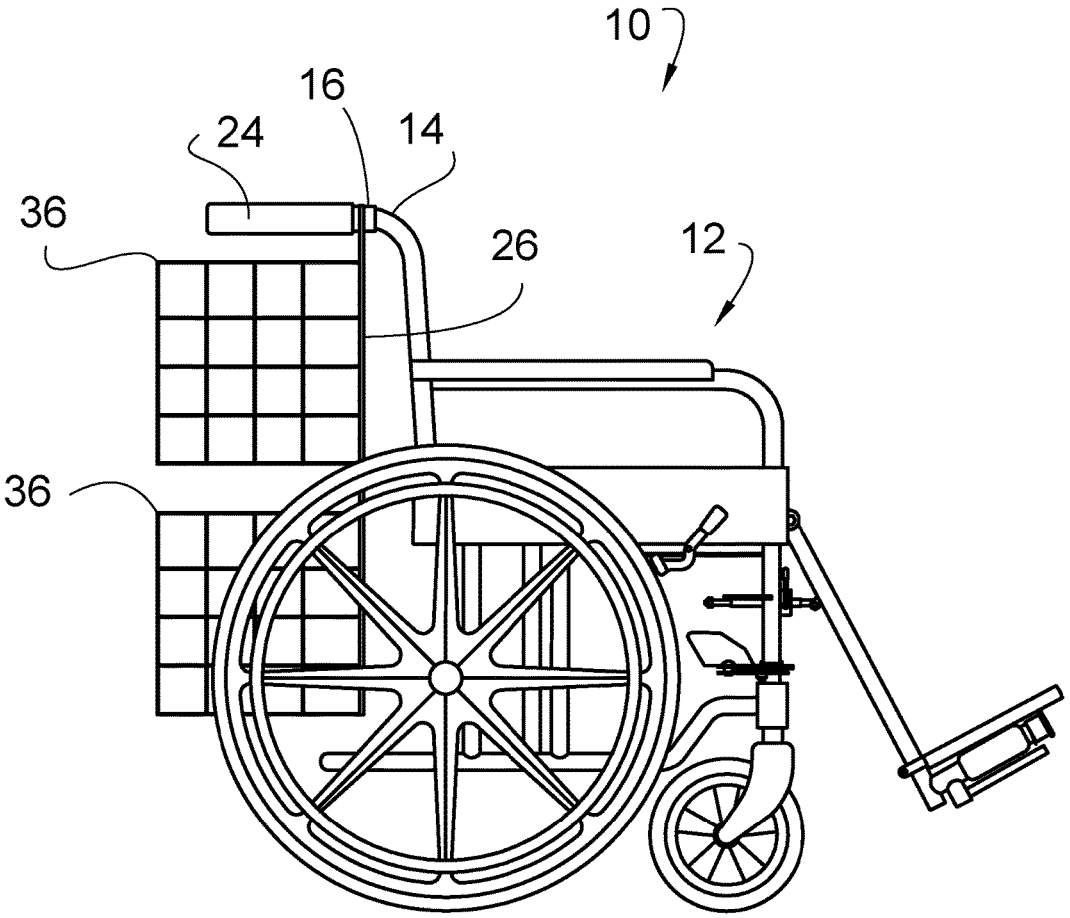
FIG. 5 is a perspective in-use view of an embodiment of the disclosure.

With reference now to the drawings, and in particular to FIGS. 1 through 5 thereof, a new basket device embodying the principles and concepts of an embodiment of the disclosure and generally designated by the reference numeral 10 will be described.

As best illustrated in FIGS. 1 through 5, the shopping basket assembly 10 generally comprises a wheelchair 12 that has a pair of handles 14 for gripping to roll the wheelchair 12. The wheelchair 12 may be a powered or unpowered wheelchair 12 of any conventional design. A pair of sleeves 16 is provided and each of the sleeves 16 is slidably positioned on a respective one of the handles 14 on the wheelchair 12. Each of the sleeves 16 has a first end 18, a second end 20 and an outer surface 22 extending therebetween. The first end 18 of each of the sleeves 16 is open for insertably receiving the respective handle 14 on the wheelchair 12.

A pair of grips 24 is provided and each of the grips 24 is positioned around a respective one of the sleeves 16. Each of the grips 24 is comprised of a resiliently compressible material, such as foam rubber or the like, to enhance gripping the sleeves 16. Each of the grips 24 is positioned around the outer surface 22 of the respective sleeve 16. Additionally, each of the sleeves 16 covers the second end 20 of the respective sleeve 16.

A panel 26 is included and each of the sleeves 16 is coupled to the panel 26 such that the panel 26 extends downwardly from the handles 14 when the sleeves 16 are positioned on the handles 14. The panel 26 has a first surface 28 and a peripheral edge 30, and the peripheral edge 30 has a top side 32 and a bottom side 34. Each of the sleeves 16 extends through the first surface 28 and the second surface of the panel 26. The sleeves 16 are spaced apart from each other on the panel 26 such that the sleeves 16 are aligned with respective one of the handles 14 on the wheelchair 12. Each of the sleeves 16 is positioned closer to the top side 32 of the panel 26 than the bottom side 34 of the panel 26. Additionally, the panel 26 may be comprised of a rigid material such as plastic or the like. The panel 26 may have a length ranging between approximately 70.0 cm and 80.0 cm and a width ranging between approximately 35.0 cm and 45.0 cm.

A pair of baskets 36 is provided and each of the baskets 36 is coupled to the panel 26 for supporting shopping items that are positioned in the baskets 36. Each of the baskets 36 is coupled to and extends away from the first surface 28 of the panel 26. Thus, each of the baskets 36 extends rearwardly away from the wheelchair 12 when the sleeves 16 are positioned on the handles 14. The baskets 36 are spaced apart from each other and are distributed between the top side 32 and the bottom side 34 of the panel 26. Each of the baskets 36 has an upper end 38 and the upper end 38 of each of the baskets 36 is open to receive shopping items. Additionally, each of the baskets 36 may comprise a plurality of intersecting members, a plurality of solid panels or any other material that can support shopping items. The baskets 36 may be spaced apart from each other a distance of approximately 20.0 cm on the panel 26.

In use, each of the sleeves 16 is slid over the respective handle 14 on the wheelchair 12 when a caregiver is pushing the wheelchair 12 during shopping. Thus, each of the baskets 36 is positioned to be accessible to the caregiver for receiving shopping items. In this way the shopping items can be carried without the need of a shopping cart or the like. Additionally, the baskets 36 can carry any objects other than shopping items when the wheelchair 12 is being pushed. In this way the caregiver has both hands free to push the wheelchair 12 while the baskets 36 carry the shopping items or the other objects. Each of the sleeves 16 is removable from the handles 14 at any time for storing the assembly.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A shopping basket and wheelchair assembly configured to facilitate shopping items to be carried on the wheelchair, said assembly comprising:

a wheelchair having a pair of handles being gripped for rolling said wheelchair;

a pair of sleeves, each of said sleeves being slidably positioned on a respective one of said handles on said wheelchair, each of said sleeves having a first end, a second end and an outer surface extending therebetween, said first end of each of said sleeves being open;

a panel having each of said sleeves being coupled thereto such that said panel extends downwardly from said handles when said sleeves are positioned on said handles, said panel having a first surface and a peripheral edge, said peripheral edge having a top side and a bottom side, each of said sleeves extending through said first surface and said second surface, said sleeves being spaced apart from each other on said panel having said sleeves being aligned with respective one of said handles on said wheelchair, each of said sleeves being positioned closer to said top side than said bottom side; and a pair of baskets, each of said baskets being coupled to said panel wherein said panel is configured to support shopping items positioned in said baskets.

2. The assembly according to claim 1, further comprising a pair of grips, each of said grips being positioned around a respective one of said sleeves, each of said grips being comprised of a resiliently compressible material wherein each of said grips is configured to enhance gripping said sleeves, each of said grips being positioned around said outer surface of said respective sleeve and covering said second end of said respective sleeve.

3. The assembly according to claim 1, wherein each of said baskets is coupled to and extending away from said first surface of said panel, said baskets being spaced apart from each other and being distributed between said top side and said bottom side of said panel, each of said baskets having a upper end, said upper end of each of said baskets being open wherein each of said baskets is configured to receive shopping items.

4. A shopping basket and wheelchair assembly configured to facilitate shopping items to be carried on the wheelchair, said assembly comprising:

a wheelchair having a pair of handles being gripped for rolling said wheelchair;

a pair of sleeves, each of said sleeves being slidably positioned on a respective one of said handles on said wheelchair, each of said sleeves having a first end, a second end and an outer surface extending therebetween, said first end of each of said sleeves being open;

a pair of grips, each of said grips being positioned around a respective one of said sleeves, each of said grips being comprised of a resiliently compressible material wherein each of said grips is configured to enhance gripping said sleeves, each of said grips being positioned around said outer surface of said respective sleeve and covering said second end of said respective sleeve;

a panel having each of said sleeves being coupled thereto such that said panel extends downwardly from said handles when said sleeves are positioned on said handles, said panel having a first surface and a peripheral edge, said peripheral edge having a top side and a bottom side, each of said sleeves extending through said first surface and said second surface, said sleeves being spaced apart from each other on said panel having said sleeves being aligned with respective one of said handles on said wheelchair, each of said sleeves being positioned closer to said top side than said bottom side; and a pair of baskets, each of said baskets being coupled to said panel wherein said panel is configured to support shopping items positioned in said baskets, each of said baskets being coupled to and extending away from said first surface of said panel, said baskets being spaced apart from each other and being distributed between said top side and said bottom side of said panel, each of said baskets having a upper end, said upper end of each of said baskets being open wherein each of said baskets is configured to receive shopping items.

* * * * *